US005985428A

United States Patent [19]

Chiba

[11] Patent Number: 5,985,428

[45] Date of Patent: Nov. 16, 1999

[54] STEEL MEMBER FOR USE UNDER HOT OR WARM CONDITIONS AND METHOD FOR PRODUCING SAME

[75] Inventor: Yositaka Chiba, Tottori-ken, Japan

[73] Assignee: Hitachi Metals, Ltd., Tokyo, Japan

[21] Appl. No.: 09/016,354

[22] Filed: Jan. 30, 1998

[30] Foreign Application Priority Data

Feb. 3, 1997 [JP] Japan ..... 9-034450

[51] Int. Cl.[6] ..... C23C 8/28

[52] U.S. Cl. ..... 428/216; 428/212; 428/336; 428/698; 428/469; 427/255.1; 427/255.2

[58] Field of Search ..... 428/216, 212, 428/336, 698, 469; 427/255.1, 255.2

[56] References Cited

U.S. PATENT DOCUMENTS

| | | | |
|---|---|---|---|
| 5,187,017 | 2/1993 | Hatano et al. | 428/469 |
| 5,595,612 | 1/1997 | Dingremont | 148/318 |
| 5,869,195 | 2/1999 | Ramanarayanan et al. | 428/610 |

*Primary Examiner*—Archene Turner
*Attorney, Agent, or Firm*—Sughrue, Mion, Zinn, Macpeak & Seas, PLLC

[57] ABSTRACT

The steel member for use under hot or warm conditions has a surface layer including (a) an oxygen-containing mixture layer comprising iron sulfide particles and iron nitride particles and substantially satisfying $0.5 \leqq S/N \leqq 10$; (b) an intermediate layer of iron sulfide, iron nitride and iron oxide; (c) and a nitride layer comprising a nitrogen-diffused layer on this order from the member surface. The member is produced by supplying a colorless ammonium sulfide solution and a yellow ammonium sulfide solution at a weight ratio of 6/1-1/1 to a gas generator to form a solution mixture from which a head gas is generated; disposing a steel member in a reactor; introducing the head gas and nitrogen into the reactor at 100–600 ppm of $H_2S$ and 0.1–1.0% of $NH_3$; supplying nitrogen and $NH_3$ to the reactor to adjust the concentration of $NH_3$ to 10–70% in the reactor; heating the reactor to 460–600° C. to carry out a gas sulfonitriding treatment on the member; and slowly cooling the sulfonitrided member at 30–25° C./hr.

19 Claims, 8 Drawing Sheets

STEEL MEMBER FOR USE UNDER HOT OR WARM CONDITIONS AND METHOD FOR PRODUCING SAME

BACKGROUND OF THE INVENTION

The present invention relates to a steel member for use under hot or warm conditions, particularly a hot- or warm-working die, and a method for producing it.

Dies for hot or warm forging are conventionally made mainly of hot-working tool steel such as SKD61, SKT4, etc. defined by JIS, and dies required to have higher durability are made of high-speed steel having better high-temperature strength such as SKD7, SKD8, etc. or steel improved therefrom.

Recent trend is generally that hot- or warm-working dies are surface-treated to impart high wear resistance and galling resistance to die surfaces while keeping toughness thereof, in response to the demand of higher precision and efficiency in working. The surface treatment applied to such dies is mainly a single-step nitriding treatment by an ion process, a salt bath process, a gas process, etc.

For instance, Japanese Patent Laid-Open No. 7-138733 discloses a method for providing a steel die with a heat cracking resistance and a plastic flow resistance by subjecting the die to an ion-nitriding treatment and then to high-frequency heating at a temperature up to 950° C. to reduce an outermost, brittle white layer containing high-concentration nitrides and to make a nitrogen-diffused layer as deep as 3.0 mm. Also, Japanese Patent Laid-Open No. 57-54551 discloses a hot-working die which is iron-nitrided at a low temperature (350–450° C.) to prevent galling while keeping the toughness of the die substrate. The effects of these methods are, however, limited to as small as 20 to 30% increase in a die life as compared with the conventional nitriding methods, suggesting that these methods are not regarded as providing remarkable improvement of the die life.

There is also a trend of near-net shaping which leads to worked articles with more complicated shapes. The near-net shaping makes larger the plastic flow of work materials during working and thus increase friction between the works and die surfaces, which results in making the temperature of the dies higher than their transformation temperatures of 700–900° C. and thus accelerating the softening of die surfaces by friction heat. As a result, the dies lose their inherent properties, resulting in poor high-temperature properties and accelerated damage of the dies.

When a single-step nitriding treatment such as an ion-nitriding treatment which is the most prevalent surface treatment for steel members at present is carried out on dies, the resultant nitrides are partially decomposed by overheat, failing to provide sufficient effects.

Other than the single-step nitriding treatment, Japanese Patent Laid-Open No. 4-228557 proposes a method and an apparatus for gas-sulfonitriding cold-slidable members operable in oils such as pistons, cylinders, etc. of hydraulic pumps, motors, etc. of construction machines in order to improve their properties of keeping lubricating oils. This method forms a surface layer comprising ferric sulfide ($FeS_2$) highly capable of keeping a lubricant as an outermost surface layer on a steel member by a secondary heat treatment at 200–350° C.

Japanese Patent Laid-Open No. 60-39155 proposes the formation, on a surface of an iron article, of a first layer mainly composed of ferric sulfide ($FeS_2$) and a second layer of iron nitride ($Fe_4N$) by bringing a decomposed gas of ammonium sulfide and an ammonia gas into contact with the iron article while heating. However, the resultant layers are likely to be porous, providing starting points of heat cracking and propagating paths thereof. Accordingly, dies produced by this technology cannot suitably be used for hot-working at a temperature of 600° C. or higher and a high pressure.

Katagiri et al. reported in *The Japan Association of Metallurgy,* Vol. 51, No. 10 (1987), pp. 930–934 the sulfonitriding treatment for forming an outermost porous surface layer of ferrous sulfide (FeS) and an underlying surface layer containing iron oxide ($Fe_3O_4$) on a steel material in 150 ppm of a hydrogen sulfide gas and 75% of an ammonia gas at 580° C. for 1–6 hours, by using a colorless ammonium sulfide solution. However, since this method uses a colorless ammonium sulfide solution as a starting material, a weight ratio of sulfur to oxygen (S/O) in the resulting surface layer is less than 0.5, failing to sufficiently lower a friction coefficient between the die surface and the work. Also, since there are likely to be starting points of heat cracking and propagating paths thereof in the porous layers, dies produced by the method of Katagiri are not suitable for plastic working at high temperature and pressure.

Momijizawa reported in *Heat Treatment,* Vol. 36, No. 6 (1996), pp. 383–387 the formation of a sulfurized layer made of FeS or $Fe_{1-x}S$ having solid lubrication in a thickness of 3–5 $\mu$m in addition to a nitride layer (on the substrate side) to improve galling resistance and wear resistance at room temperature (20° C.), by a gas-nitriding cycle comprising various treatment cycles using gases supplied from an $H_2S/N_2$ bottle, a pure $N_2$ bottle, a pure $NH_3$ bottle and a $CO_2$ bottle. The resultant surface layer of steel has a nitride layer and a black sulfurized layer with solid lubrication on this order from a steel substrate. It is reported that since sulfur substantially does not form a solid solution with ($\alpha$-Fe unlike nitrogen, the sulfurized layer of FeS or $Fe_{1-x}S$ is limited on a surface of the steel, not being diffused inside it. However, if dies subjected to such a treatment are used for high-temperature working, ferric sulfide ($FeS_2$) and ferrous sulfide (FeS or $Fe_{1-x}S$) easily peel off from the nitride layer due to the difference in thermal expansion coefficient therebetween. Thus, the dies treated by this method cannot be used as hot- or warm-working dies.

In addition, Japanese Patent Publication No. 7-42566 proposes the formation of iron oxide ($Fe_3O_4$) on iron articles made of soft steel or cast iron such as bolts, nuts, etc. to prevent corrosion in their portions buried in earth and also to improve corrosion resistance and appearance in their portions exposed in the air.

In general, the damage of a die takes place in a manner as described below during the plastic working at a high temperature. A surface of the die is subjected to thermal shock by contact with the work as follows: The plastic working is carries out at a high temperature such that the heated work plastically flows along a working surface of the die while being pressed onto the die surface, thereby generating friction heat and plastic deformation heat. During this plastic working process, the die surface is subjected to quick thermal expansion by rapid temperature increase. After completion of the plastic working, the worked article is removed from the die, resulting in the shrinkage of the die surface by cooling.

As a result of repeated plastic working as described above, the die surface is not only subjected to thermal fatigue by expansion and shrinkage, but also the die surface softened by heat has a decreased resistance to stress generated by plastic working and expansion and shrinkage, so that heat cracking and plastic flow are more likely on the die surface. Thus, damage such as wear proceeds on the die surface. In this case, galling would be likely to take place if the die surface is in direct contact with the work. The generation of galling makes easier thermal conduction from the work to the die surface, accelerating the damage of the die.

Accordingly, a lubricant or a parting agent is applied onto the die surface every cycle in an actual operation, so that the die surface and the work are not in direct contact with each other by the lubricant or the parting agent present in a film state between them. However, the die surface heated to a high temperature is rapidly cooled by applying the above agent, resulting in larger shrinkage in a unit time.

As described above, a surface layer formed on a steel material by these sulfonitriding methods is likely to provide starting points of heat cracking and propagating paths thereof due to its porosity, when the surface-treated steel material is used as a die for plastic working at a high temperature. Also, ferric sulfide ($FeS_2$) and ferrous sulfide (FeS or $Fe_{1-x}S$) easily peel off from an iron nitride layer to which these sulfides are adjacent, due to the difference in thermal expansion coefficient therebetween. Thus, the dies treated by these sulfonitriding methods cannot be used as hot- or warm-working dies.

SUMMARY OF THE INVENTION

The inventor has investigated how to prevent direct thermal conduction from a work, which is not only heated at a high temperature in advance but also subjected to temperature elevation by plastic deformation, to a die surface, thereby drastically improving the life of the die. As a result, it has been found that if the die surface is modified to have a dense surface layer which prevents galling between the die surface and the work and exerts excellent lubricating and heat insulation effects, it would be possible to suppress the generation of friction heat and the softening of the die surface due to thermal conduction, thereby improving the die life. As a result of experiments on each layer formed on a surface of a steel member for use under hot or warm conditions from the above point of view, it has been found that excellent effects can be achieved, when an oxygen-containing mixture layer comprising iron sulfide particles and iron nitride particles is formed as an outermost surface layer on a steel member substrate at concentration ratio of sulfur to nitrogen (S/N) by weight within a particular range.

Thus, the steel member for use under hot or warm conditions according to the present invention has a surface layer which comprises an oxygen-containing mixture layer comprising iron sulfide particles and iron nitride particles and substantially satisfying the formula of $0.5 \leqq S/N \leqq 10$.

The steel member for use under hot or warm conditions preferably has a surface layer which comprises an oxygen-containing mixture layer comprising iron sulfide particles and iron nitride particles and substantially satisfying the formula of $0.5 \leqq S/N \leqq 10$; and a nitride layer on this order from the member surface.

The steel member for use under hot or warm conditions preferably has a surface layer which comprises an oxygen-containing mixture layer comprising iron sulfide particles and iron nitride particles and substantially satisfying the formula of $0.5 \leqq S/N \leqq 10$; and an intermediate layer comprising iron sulfide, iron nitride and iron oxide on this order from the member surface.

The steel member for use under hot or warm conditions preferably has a surface layer which comprises an oxygen-containing mixture layer comprising iron sulfide particles and iron nitride particles and substantially satisfying the formula of $0.5 \leqq S/N \leqq 10$; an intermediate layer comprising iron sulfide, iron nitride and iron oxide; and a nitride layer on this order from the member surface.

The steel member for use under hot or warm conditions preferably has a surface layer which comprises an oxygen-containing mixture layer comprising iron sulfide particles and iron nitride particles and substantially satisfying the formula of $0.5 \leqq S/N \leqq 10$; an intermediate layer comprising iron sulfide, iron nitride and iron oxide; and a nitride layer comprising a white layer and a nitrogen-diffused layer on this order from the member surface.

The steel member for use under hot or warm conditions preferably has a surface layer which comprises an oxygen-containing mixture layer comprising iron sulfide particles and iron nitride particles and substantially satisfying the formula of $0.5 \leqq S/N \leqq 10$; an intermediate layer comprising iron sulfide, iron nitride and iron oxide; and a nitride layer comprising a nitrogen-diffused layer on this order from the member surface.

The method for producing a steel member for use under hot or warm conditions according to the present invention comprises the steps of:

(1) supplying a colorless ammonium sulfide solution and a yellow ammonium sulfide solution at a weight ratio of 6/1-1/1 to a gas generator to form a mixture of the solutions which generates a head gas;

(2) disposing a steel member in a reactor;

(3) introducing a mixed gas comprising the head gas and a carrier gas consisting essentially of a nitrogen gas into the reactor, the mixed gas being adjusted such that it has a hydrogen sulfide gas concentration of 100–600 ppm and an ammonia gas concentration of 0.1–1.0%;

(4) supplying a nitrogen gas and an ammonia gas from different sources to the reactor to adjust the concentration of ammonia to 10–70% in the reactor;

(5) heating the reactor to 460–600° C. to carry out a gas sulfonitriding treatment on the steel member; and (6) slowly cooling the sulfonitrided steel member at a cooling speed of 30–250° C./hr.

In one preferred embodiment, the concentration of ammonia in the reactor is 20–70%, and the heating temperature is 500–600° C.

In another preferred embodiment, the concentration of ammonia in the reactor is 10–40%, and the heating temperature is 460–550° C.

EXAMPLE 1

Figure 1A:
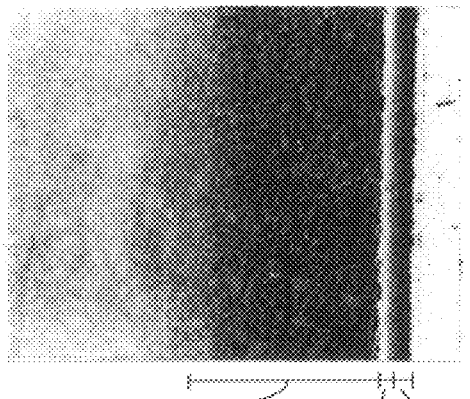
FIG. 1(*a*) is an optical photomicrograph showing the structure of a surface layer comprising a mixture layer, a white layer and a nitrogen-diffused layer in Sample No. 5 in Comparative
Figure 1B:
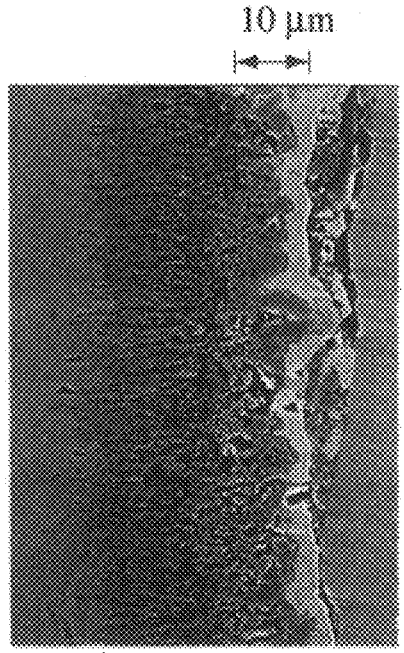
Figure 1C:
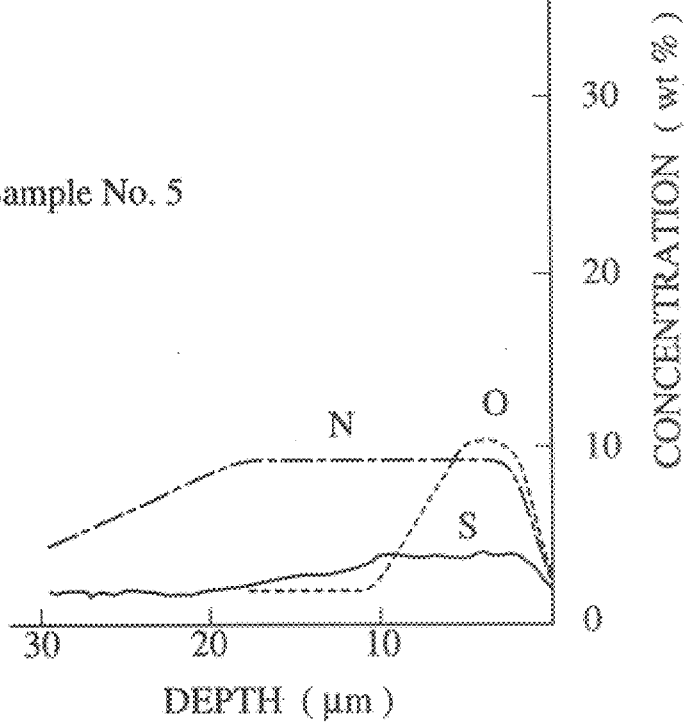
Figure 2A:
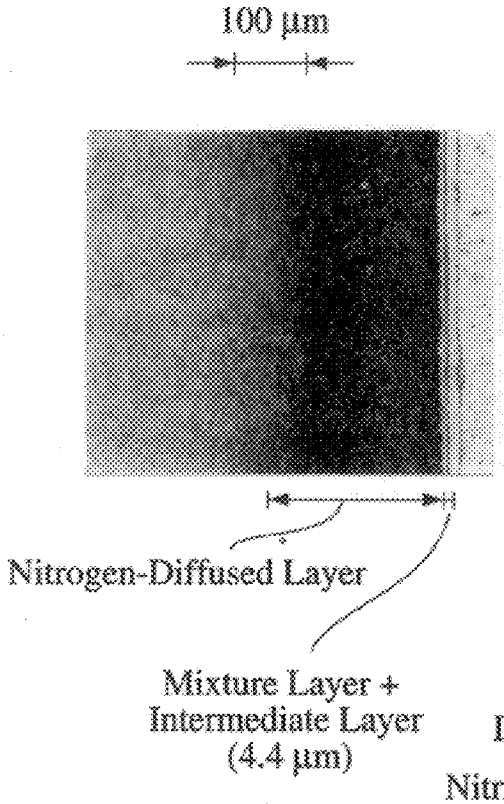
Figure 2B:
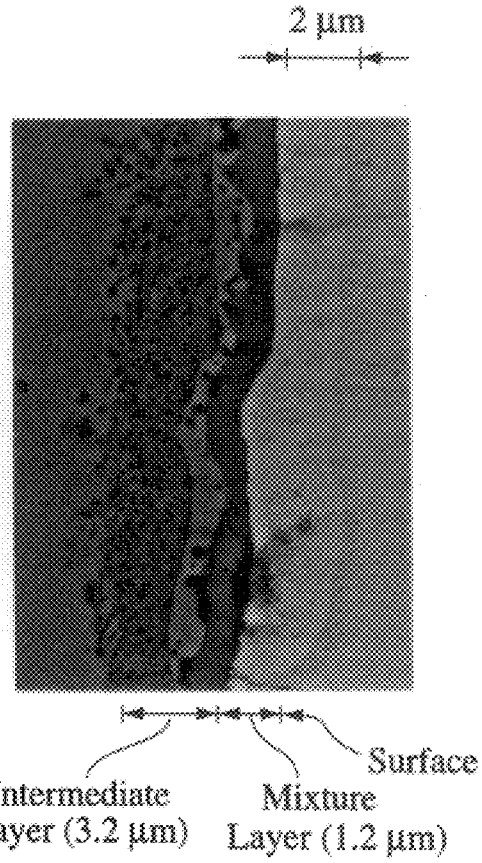
Figure 2C:
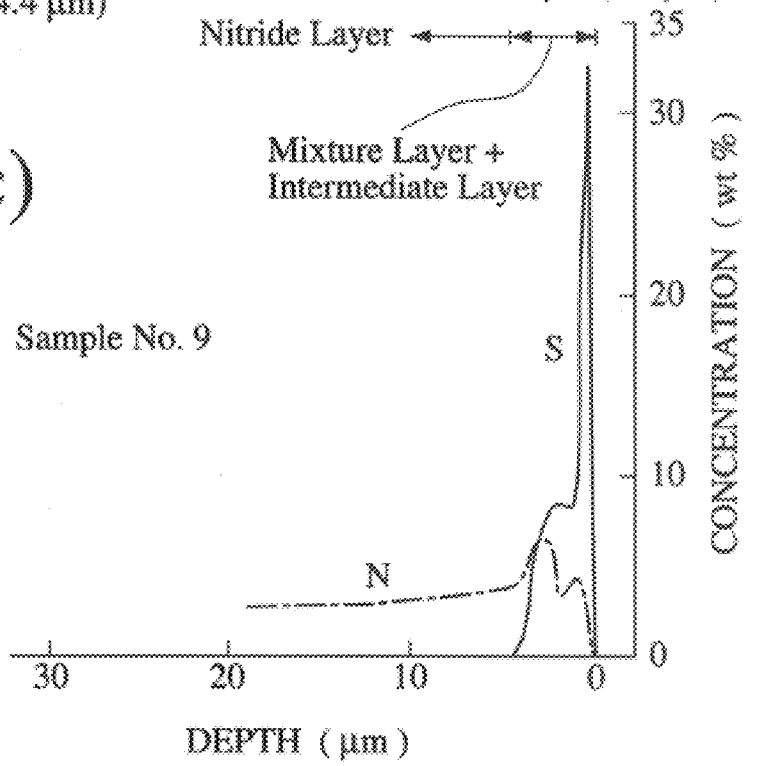
Figure 3A:
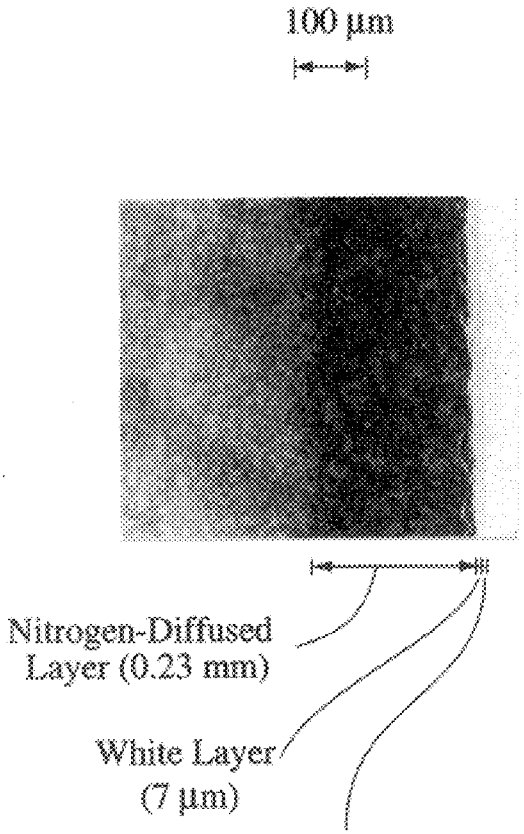
Figure 3B:
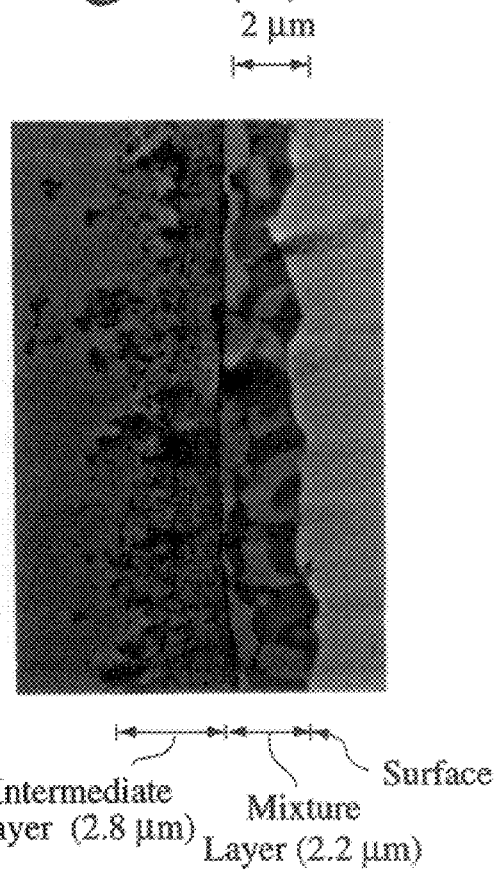
Figure 3C:
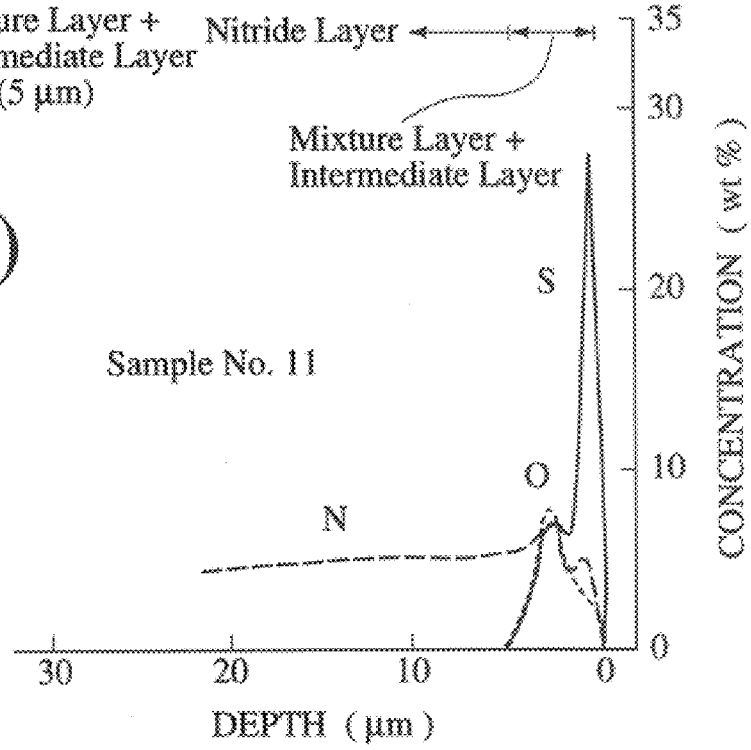
Figure 4A:
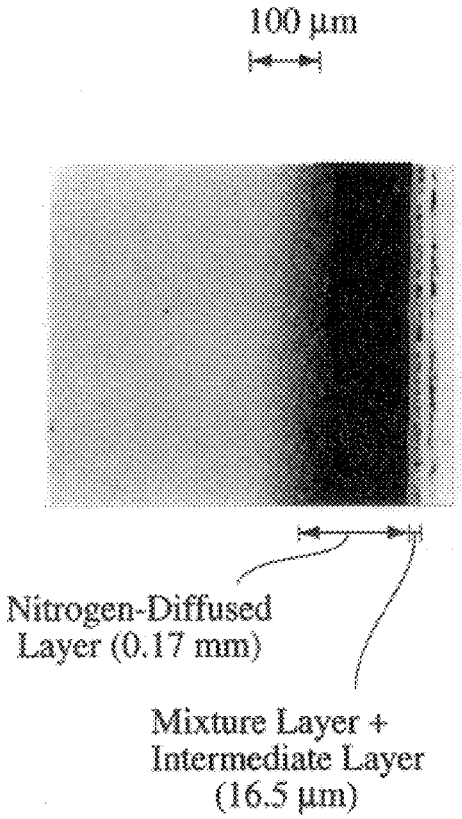
Figure 4B:
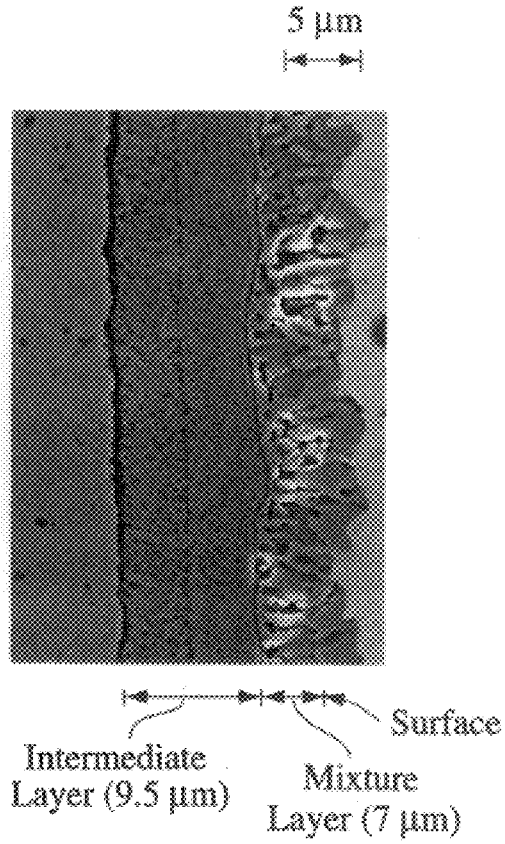
Figure 4C:
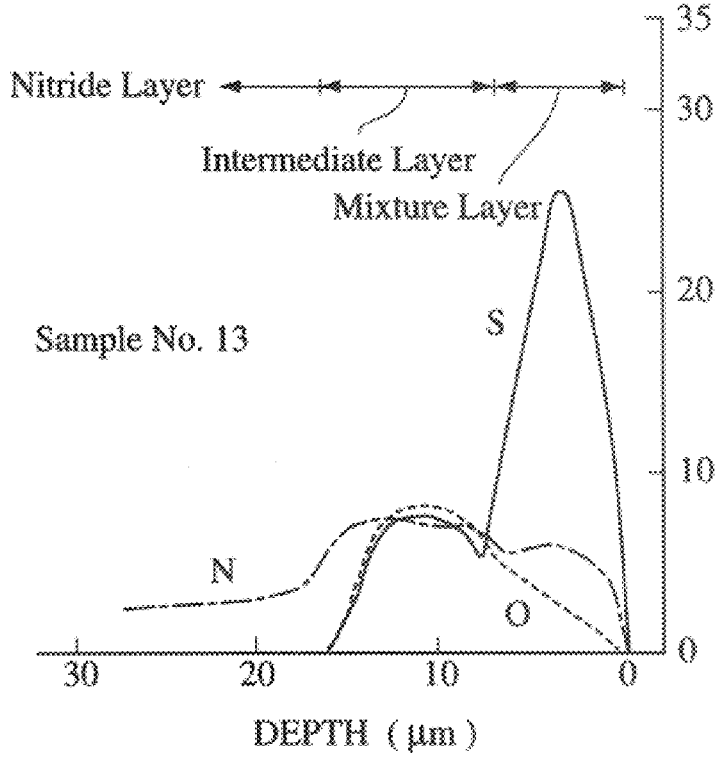
Figure 5A:
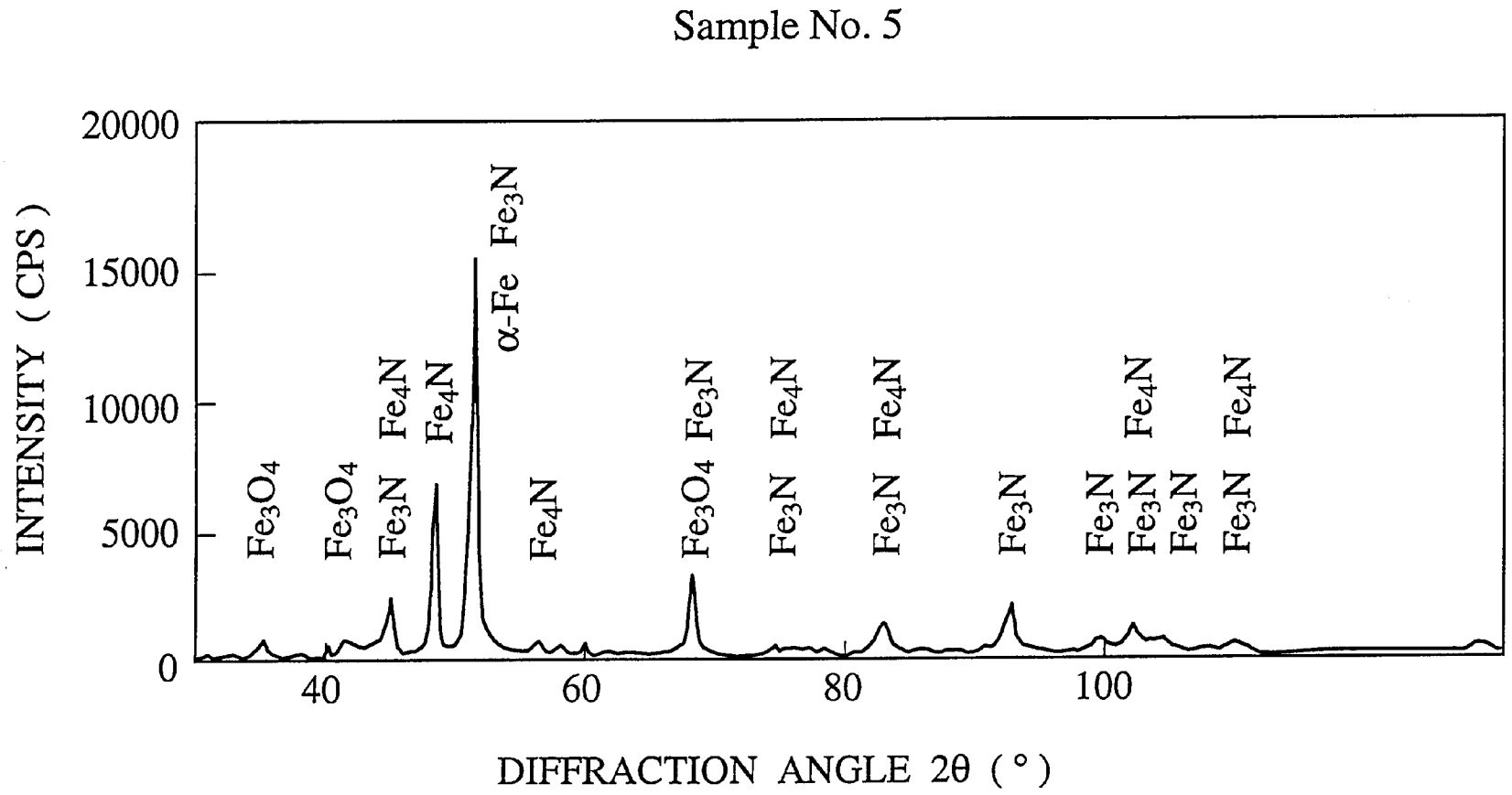
Figure 5B:
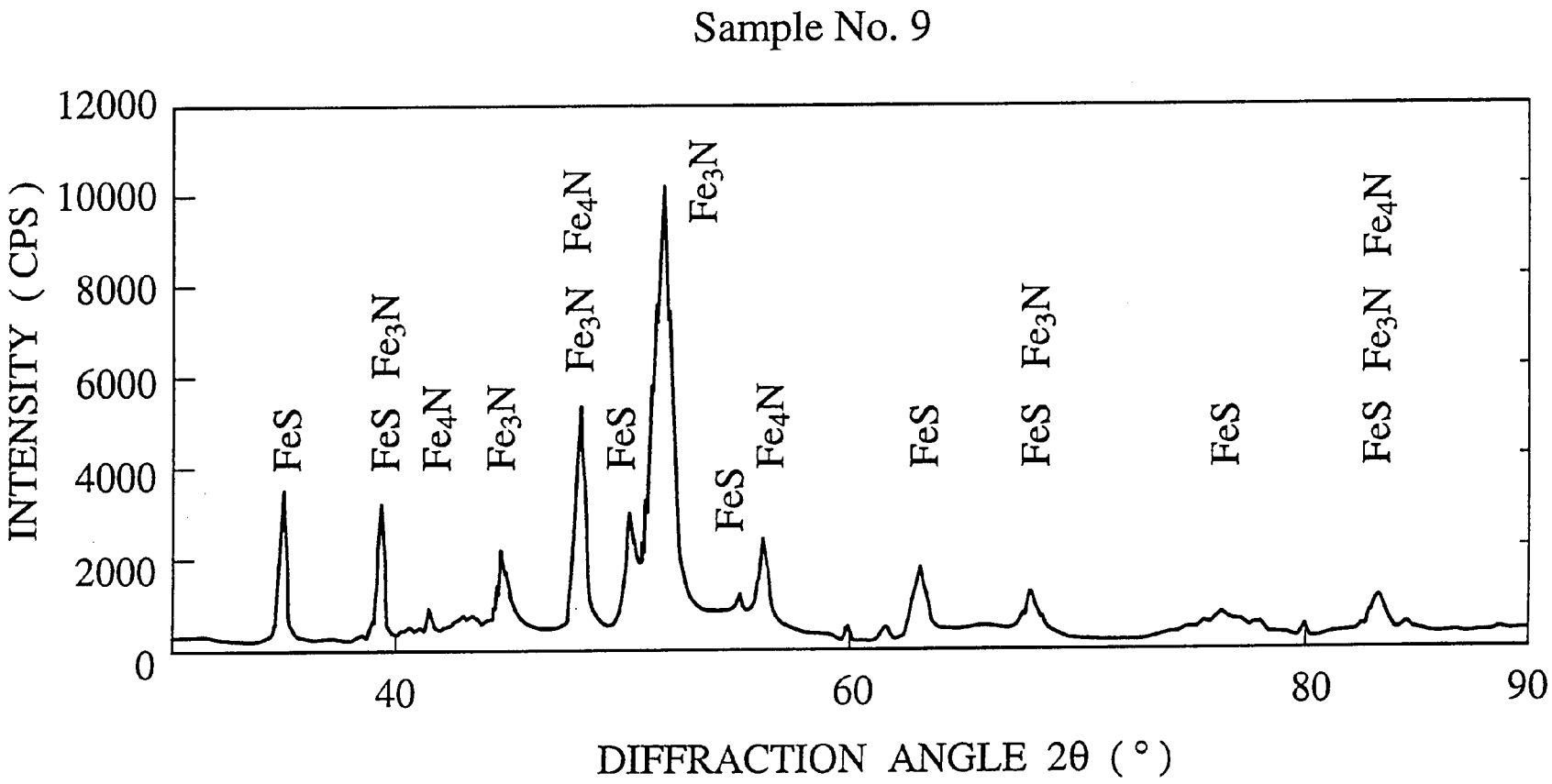
Figure 5C:
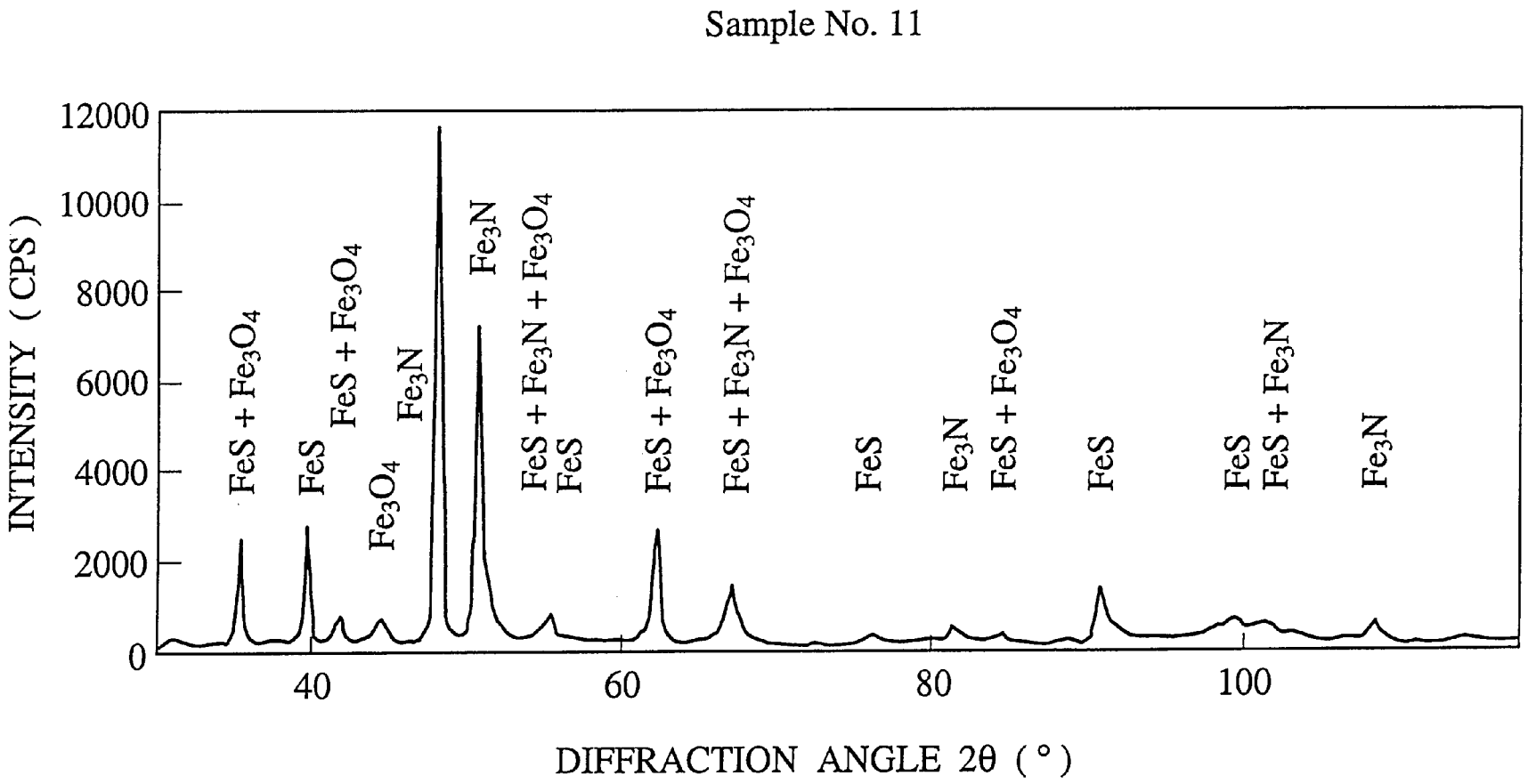
Figure 5D:
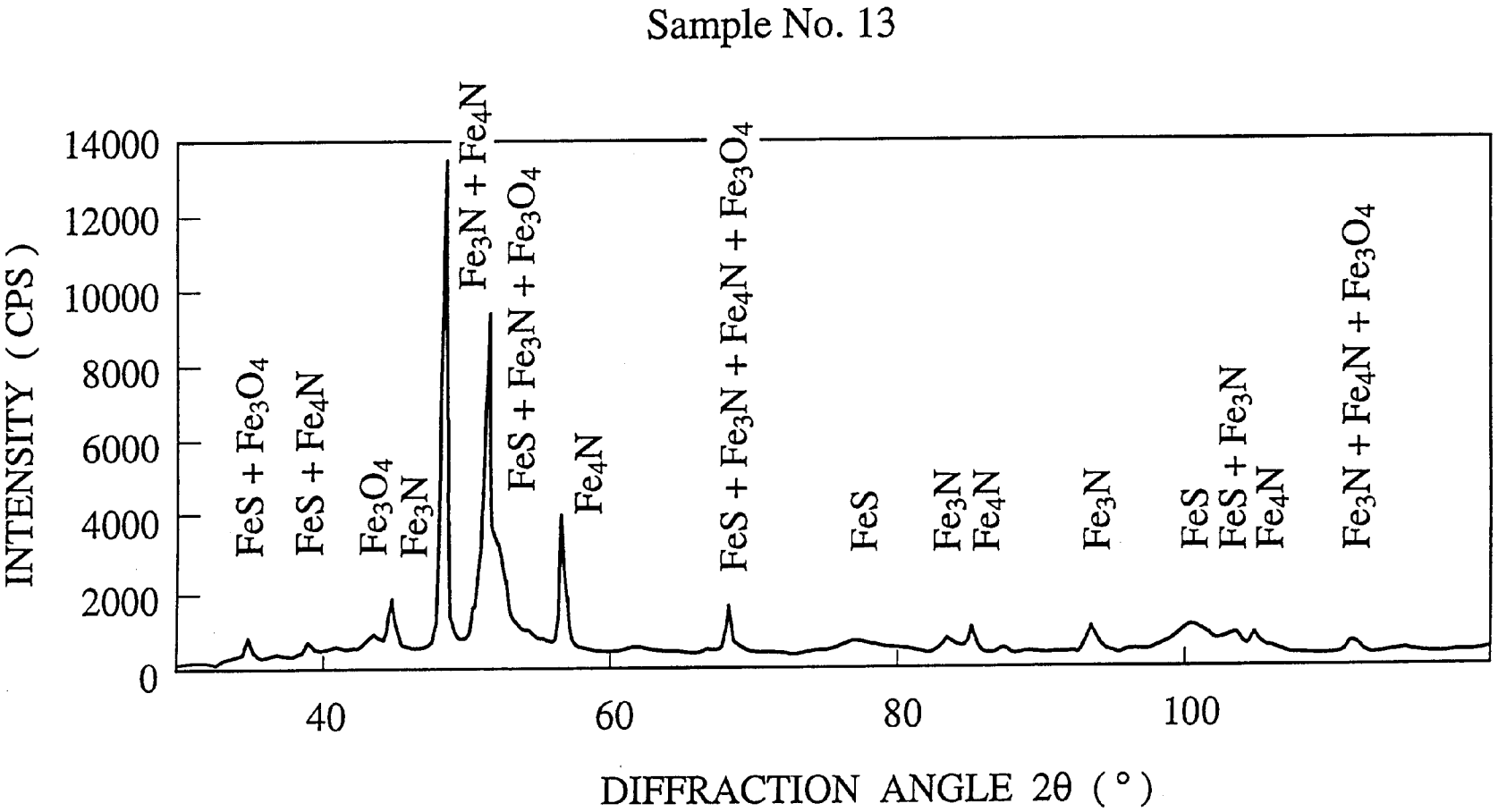

FIG. 1(*b*) is an electron photomicrograph showing the structure of a mixture layer in Sample No. 5 in Comparative Example 1;

FIG. 1(*c*) is an EPMA chart of a mixture layer in Sample No. 5 in Comparative Example 1;

FIG. 2(*a*) is an optical photomicrograph showing the structure of a surface layer comprising a mixture layer, an intermediate layer and a nitrogen-diffused layer in Sample No. 9 in Comparative Example 1;

FIG. 2(*b*) is an electron photomicrograph showing the structures of a mixture layer and an intermediate layer in Sample No. 9 in Comparative Example 1;

FIG. 2(*c*) is an EPMA chart of a mixture layer, an intermediate layer and a nitride layer in Sample No. 9 in Comparative Example 1;

FIG. 3(*a*) is an optical photomicrograph showing the structure of a surface layer comprising a mixture layer, an intermediate layer, a white layer and a nitrogen-diffused layer in Sample No. 11 in Example 1;

FIG. 3(*b*) is an electron photomicrograph showing the structures of a mixture layer and an intermediate layer in Sample No. 13 in Example 1;

FIG. 3(*c*) is an EPMA chart of a mixture layer, an intermediate layer and a nitride layer in Sample No. 11 in Example;

FIG. 4(*a*) is an optical photomicrograph showing the structure of a surface layer comprising a mixture layer, an intermediate layer and a nitrogen-diffused layer in Sample No. 13 in Example 1;

FIG. 4(*b*) is an electron photomicrograph showing the structures of a mixture layer and an intermediate layer in Sample No. 11 in Example 1;

FIG. 4(*c*) is an EPMA chart of a mixture layer, an intermediate layer and a nitride layer in Sample No. 13 in Example 1;

FIG. 5(*a*) is an X-ray diffraction chart of Sample No. 5 in Comparative Example 1;

FIG. 5(*b*) is an X-ray diffraction chart of Sample No. 9 in Comparative Example 1;

FIG. 5(*c*) is an X-ray diffraction chart of Sample No. 11 in Example 1; and FIG. 5(*d*) is an X-ray diffraction chart of Sample No. 13 in Example 1.

DETAILED DESCRIPTION OF THE PREFERRED EMBODIMENTS

Steel member for use under hot or warm conditions

The steel member for use under hot or warm conditions according to the present invention has a surface layer which comprises an oxygen-containing mixture layer comprising iron sulfide particles and iron nitride particles and substantially satisfying the formula of $0.5 \leqq S/N \leqq 10$. The surface layer preferably further comprises an intermediate layer, and a nitride layer comprising a white layer and a nitrogen-diffused layer. These layers can visually be distinguished on a photomicrograph of the surface layer formed on the steel member.

(1) Steel member

The present invention is applicable to any types of steel. Particularly in the case of hot- or warm-working dies, it is preferable to use hot-working tool steel having good high-temperature strength and toughness such as SKD61, SKT4, etc. defined by JIS. SKD7, DK8, high-speed steel and improved steel thereof may also be used.

(2) Mixture layer

The steel member for use under hot or warm conditions, which may be called simply as "hot- or warm-usable steel member" hereafter, has a surface layer comprising an oxygen-containing mixture layer which comprises iron sulfide particles and iron nitride particles.

The mixture layer is substantially composed of iron sulfide particles and iron nitride particles, and contains oxygen. The iron sulfide particles are mainly in the form of ferric sulfide ($FeS_2$) or ferrous sulfide (FeS or $Fe_{1-x}S$). The iron nitride particles are mainly in the form of $Fe_3N$.

The percentages of the iron sulfide particles and the iron nitride particles are such that the concentration ratio of sulfur to nitrogen (S/N) by weight satisfies the formula of $0.5 \leqq S/N \leqq 10$. The S/N ratio is determined by dividing the maximum value of S by the maximum value of N in the mixture layer.

When the S/N ratio is less than 0.5, the mixture layer fails to show sufficient reduction of a friction coefficient between the surfaces of the hot- or warm-usable steel member (sliding surfaces when used as machine members, working surfaces when used as dies, etc.) and works. On the other hand, when the S/N ratio is more than 10, the adhesion of the mixture layer to the steel member substrate is insufficient, making likely the peeling or removal of the mixture layer from the steel member substrate and thus making the hot- or warm-usable steel member incapable of enduring a long period of use. The more preferred S/N ratio is 2–8. Incidentally, the concentration of S in the mixture layer is preferably 5–35 weight %, more preferably 15–30 weight %, particularly 20–30 weight %.

With respect to oxygen, it may be dissolved in the iron sulfide particles and the iron nitride particles and may also exist in the form of iron oxide such as $Fe_3O_4$. The amount of oxygen in the mixture layer may be 1–15 weight %, preferably 2–10 weight %.

The thickness of the mixture layer is 0.1–20 $\mu$m. when the mixture layer is as thin as less than 0.1 $\mu$m, sufficient reduction of a friction coefficient cannot be achieved. On the other hand, when the mixture layer is as thick as more than 20 $\mu$m, the mixture layer is likely to peel off. The more preferred thickness of the mixture layer is 2–10 $\mu$m.

(3) Nitride layer

The surface layer of the hot- or warm-usable steel member preferably comprises a nitride layer below the mixture layer (on the side of the steel member substrate). The nitride layer comprises a nitrogen-diffused layer and may further contain a white layer which may be called white nitrided layer.

The nitrogen-diffused layer contains $Fe_4N$, particularly, $\gamma'$-$Fe_4N$. The white layer contains $Fe_{2-3}N$, particularly $\epsilon$-$Fe_{2-3}N$.

For instance, in the case of a die having a relatively low projections and/or shallow recesses on a working surface, or in the case of a die for works which are easily plastically workable, the nitride layer preferably comprises a white layer together with a nitrogen-diffused layer. On the other hand, in the case of a die having a high or sharp projections and/or deep or sharp recesses on a working surface, or in the case of a die for works which are difficult to plastically work, the above hard white layer is likely to provide starting points of cracks, indicating that the nitride layer. preferably is preferably free of the white layer The maximum hardness of the nitride layer is 900 Hv or more to improve the strength of the hot- or warm-usable steel member.

When the hot- or warm-usable steel member is used as a member such as a machine part slidable along the other member at a relatively high temperature or as a die for plastic working under high pressure, the nitride layer has the effects of supplementing the strength of the surface layer of the hot- or warm-usable steel member and preventing the galling resistance from decreasing in a short period of time after the mixture layer partially wears out by a long period of operation.

(4) Intermediate layer

The surface layer of the hot- or warm-usable steel member preferably comprises an intermediate layer below the mixture layer. If there is a nitride layer, the intermediate layer exists between the mixture layer and the nitride layer.

The intermediate layer serves to increase the adhesion of the mixture layer to the steel member substrate directly or via the nitride layer. The intermediate layer comprises iron sulfide, iron nitride and iron oxide preferably in proportions of 20-40/20-40/20-40 by weight. The intermediate layer preferably contains 1–10 weight % of S.

The thickness of the intermediate layer is 0.1–20 $\mu$m. when the intermediate layer is as thin as less than 0.1 $\mu$m, sufficient effect of increasing the adhesion of the mixture layer to the substrate with or without the nitride layer cannot be achieved.

On the other hand, when the intermediate layer is as thick as more than 20 $\mu$m, the mixture layer is likely to peel off. The more preferred thickness of the intermediate layer is 2–10 $\mu$m.

The hot- or warm-usable steel members of the present invention may be used for members for forming works at 400° C. or higher, or members used in combination of other members heated at 400° C. or higher. The hot- or warm-usable steel members may also be used as members heated at 600° C. or higher, particularly 800° C. or higher. Such members include sliding members such as rolls, rails and guides for forming aluminum wheels, etc.; pins usable at high or warm temperature such as extrusion pins, core pins, insert pins, etc.; extrusion dies; dies for forming gears, valves, etc.; hot- or warm-working dies such as hot-forging dies, pressing dies, etc.

[2] Method for producing hot- or warm-usable steel member

The steel member for use under hot or warm conditions is produced by a method comprising the steps of (1) supplying a colorless ammonium sulfide solution and a yellow ammonium sulfide solution to a gas generator to form their mixture which generates a head gas; (2) disposing a steel member in a reactor; (3) introducing a mixed gas comprising the head gas and a carrier gas consisting essentially of a nitrogen gas into the reactor; (4) supplying a nitrogen gas and an ammonia gas from different sources to the reactor to adjust the concentration of ammonia; (5) heating the reactor to carry out a gas sulfonitriding treatment on the steel member; and (6) slowly cooling the sulfonitrided steel member. The term "sulfonitriding" used herein means that sulfurizing and nitriding take place simultaneously on a surface of the steel member.

(1) Head gas

A colorless ammonium sulfide solution and a yellow ammonium sulfide solution are supplied at a weight ratio of 6/1-1/1 to a gas generator to form a mixture of the solutions which generates a gas, simply called "head gas." The head gas generated from and residing above a surface of the mixed solution is supplied to a reactor.

The colorless ammonium sulfide solution, which is expressed by $(NH_4)S_x$, is formed by introducing hydrogen sulfide into an ammonium sulfide solution. The colorless ammonium sulfide contains a low concentration of hydrogen sulfide and a large percentage of water. The concentration of S in the colorless ammonium sulfide is generally 0.5–1 weight %. The yellow ammonium sulfide solution, which is also expressed by $(NH_4)S_x$, is formed by introducing hydrogen sulfide into an ammonium sulfide solution and then dissolving sulfur therein. The yellow ammonium sulfide solution contains a high concentration of hydrogen sulfide and a small percentage of water. The concentration of S in the yellow ammonium sulfide solution is generally 5–6 weight %. The colorless ammonium sulfide solution and the yellow ammonium sulfide solution are defined by JIS K8943.

In place of the ammonium sulfide solution, an ammonium sulfite hydrate, an ammonium sulfite solution, etc. may be used as a source for sulfonitriding and oxidation. Therefore, it should be noted that the terms "colorless ammonium sulfide solution" and "yellow ammonium sulfide solution" include these compounds.

A head gas generated from the colorless ammonium sulfide solution contains 30 ppm of $H_2S$ at 25° C., while a head gas generated from the yellow ammonium sulfide solution contains 1250 ppm of $H_2S$ at 25° C. To form the above surface layer on the steel member, the head gas should contain 100–600 ppm of $H_2S$. Accordingly, the weight ratio of the colorless ammonium sulfide solution to the yellow ammonium sulfide solution should be 6/1-1/1. The more preferred weight ratio of the colorless ammonium sulfide solution to the yellow ammonium sulfide solution is 5/1-3/1. Incidentally, the mixture of the colorless ammonium sulfide solution and the yellow ammonium sulfide solution may be at a temperature of 20–30° C. in the gas generator.

(2) Carrier gas

The carrier gas is usually a nitrogen gas and may further contain an argon gas. the ratio of the head gas to the carrier gas is determined such that a mixed gas comprising the head gas and the carrier gas has a hydrogen sulfide gas concentration of 100–600 ppm and an ammonia gas concentration of 0.1–1.0%.

(3) Supplemental gas

A supplemental gas supplied from different sources is a nitrogen gas and an ammonia gas. The ratio of an ammonia gas to a nitrogen gas in the supplemental gas and the ratio of the supplemental gas to the mixed gas (the head gas +the carrier gas) are determined, such that an atmosphere in the reactor (a mixture of the head gas, the carrier gas and the supplemental gas) has an ammonia concentration determined depending on what surface layer structure is to be formed and how high the steel member is heated. In general, the supplemental gas contains 20–80% of a nitrogen gas and 80–20% of an ammonia gas.

(4) Gas sulfonitriding treatment

The steel member is displace in a reactor heated generally at 460–600° C., into which the head gas, the carrier gas and the supplemental gas are introduced.

When the steel member is formed with a surface layer comprising a mixture layer with or without an intermediate layer and a nitrogen-diffused layer (free of a white layer), the heating temperature of the reactor should be relatively low to suppress the diffusion of nitrogen into the steel member substrate, and the concentration of ammonia, a source of diffusing nitrogen, in the reactor should also be low. Accordingly, the heating temperature of the reactor is 460–550° C., and the ammonia concentration is 10–40%

On the other hand, when the steel member is formed with a surface layer comprising a mixture layer and a nitride layer consisting essentially of a white layer and a nitrogen-diffused layer with or without an intermediate layer, the heating temperature of the reactor should be relatively high to increase the diffusion of nitrogen into the steel member substrate, and the concentration of ammonia in the reactor should also be high. Accordingly, the heating temperature of the reactor is 500–600° C., and the ammonia concentration is 20–70%.

The above relations of the gas composition in the reactor and the heating temperature to the surface layer structure are summarized as follows:

| Surface Layer Structure | Gas Composition In Reactor (%) | Temperature (° C.) |
|---|---|---|
| Mixture layer + Nitrogen-diffused layer | $H_2S$: 100–600 ppm, $NH_3$: 10–40% | 460–550 |
| Mixture layer + Intermediate layer + Nitrogen-diffused layer | $H_2S$: 100–600 ppm, $NH_3$: 10–40% | 460–550 |
| Mixture layer + White layer + Nitrogen-diffused layer | $H_2S$: 100–600 ppm, $NH_3$: 20–70% | 500–600 |
| Mixture layer + Intermediate layer + White layer + Nitrogen-diffused layer | $H_2S$: 100–600 ppm, $NH_3$: 20–70% | 500–600 |

(5) Cooling

The surface-treated steel member is then slowly cooled at a cooling speed of 30–250° C./hr. When it is cooled at a cooling speed of more than 250° C./hr, the mixture layer is likely to peel off from the steel member substrate. On the other hand, when it is cooled at a cooling speed of less than 30° C./hr, it takes too much time to cool the surface-treated steel member, for instance, 9.7 hours to cool the surface-treated steel member from 540° C. to 250° C. The more preferred cooling speed is 50–150° C./hr.

The surface-treated steel member thus prepared has a dense surface layer which has small friction coefficient and high heat insulation. Particularly, when the hot- or warm-usable steel member of the present invention is used as a hot- or warm-working die, iron sulfide should exist in the surface layer to increase the galling resistance.

The present invention will be explained in further detail by way of the following Examples without intention of restricting the scope of the present invention.

EXAMPLE 1, COMPARTIVE EXAMPLE 1

(A) Preparation of samples

Two types of steel (Sample Nos. 1 and 2) each having a composition shown in Table 1 were prepared, and hardened and tempered to provide a steel sample (Steel 1) having a hardness of 48 HRC and a steel sample (Steel 2) having a hardness of 53 HRC.

TABLE 1

| | Chemical Composition (weight %) | | | | | | | | | | $AC_1$ Transformation Temperature |
|---|---|---|---|---|---|---|---|---|---|---|---|
| Sample | C | Si | Mn | Ni | Cr | W | Mo | V | Co | Fe | (° C.) |
| Steel 1 | 0.35 | 0.3 | 0.8 | 0.8 | 3.3 | — | 2.5 | 0.6 | 0.8 | Bal. | 822 |
| Steel 2 | 0.40 | 0.25 | 0.5 | — | 4.4 | 2.0 | 1.5 | 1.6 | 1.0 | Bal. | 858 |

Each of the above steel was formed into a cylindrical rod sample having a diameter of 5 mm and a length of 20 mm, and an end of each rod sample was finished by a grinder. Samples were subjected to various surface treatments listed in Table 2 below.

TABLE 2

| | | | Treatment Conditions | | |
|---|---|---|---|---|---|
| Treatment No. | Type of Treatment | Ammonium Sulfide Solution | Temp. (° C.) | Time (hour) | $NH_3$ Gas (%)(1) |
| 1 | No Treatment | — | — | — | — |
| 2(2) | Ion-Nitriding | — | 525 | 16 | 25 |
| 3(3) | Salt Bath Sulfonitriding A | — | 570 | 10 | — |
| 4(4) | Salt Bath Sulfonitriding B | — | 565 | 7 | — |
| 5 | Gas Sulfonitriding by Gas Supplied from High-Pressure Gas Bottles | — | 540 | 20 | 20 |
| 6 | Gas Sulfonitriding Utilizing Ammomium Sulfide Solutions(5) | Colorless/Yellow = 4/1, 150 ppm $H_2S$, 0.5% $NH_3$(6) | 540 | 20 | 50 |
| 7 | Gas Sulfonitriding Utilizing Ammonium Sulfide Solutions(5) | Colorless/Yellow = 4/1, 150 ppm $H_2S$, 0.5% $NH_3$(6) | 540 | 10 | 20 |
| 8 | Gas Sulfonitriding Utilizing Ammonium Sulfide Solutions(5) | Colorless/Yellow = 4/1, 150 ppm $H_2S$, 0.5% $NH_3$(6) | 570 | 10 | 50 |

Note:

(1)A concentration of an ammonia gas in the reactor.

(2)A composition of a gas in which the ion-nitriding was carried out was $H_2$:$N_2$:Ar = 2:2:4.

(3)Immersed in a salt bath at 570° C. for 10 hours. The composition of the salt bath was as follows: KOCN: 65 weight %, NaOH: 32 weight %, and $K_2S$: 3 weight %.

(4)Immersed in a salt bath at 565° C. for 7 hours. The composition of the salt bath was as follows: the salt bath is as follows: KOCN: 75 weight %, KCl: 24.5 weight %, and $Na_2S_2O_3$: 0.5 weight %.

(5)Cooling speed was 58° C./hour from 540° C. to 250° C.

(6)A concentration ratio of a colorless ammonium sulfide solution to yellow ammonium sulfide solution by weight was 4/1, and the head gas contained 150 ppm of $H_2S$ and 0.5% of $NH_3$.

(B) Hot-galling test

The hot-galling test comprised (a) rotating a rod sample, one end of which was firmly held by a chuck of a drilling machine, at 1540 rpm; and (b) pressing the other end of the rod sample onto a steel block of SNCM439 heated at 600° C., such that the rod sample was subjected to friction sliding on the steel block at a pressing load of 0.31–2.78 KN for 30 seconds. A maximum galling-free pressure (MPa) was determined by dividing a pressing load at which galling took place by a cross section of the rod sample to evaluate a galling resistance of each rod sample. The test results are shown in Table 3 together with surface structures of the rod samples after various surface treatments.

TABLE 3

| Sample No. | Steel | Treatment No. | Structure of Surface Layer |
|---|---|---|---|
| Comparative Example 1 | | | |
| 1 | Steel 1 | 1 | No |
| 2 | Steel 2 | 1 | No |
| 3 | Steel 1 | 2 | White layer + nitrogen-diffused layer |
| 4 | Steel 2 | 2 | White layer + nitrogen-diffused layer |
| 5 | Steel 1 | 3 | Oxide layer (small amount of S) + white layer + nitrogen-diffused layer |
| 6 | Steel 2 | 3 | Oxide layer (small amount of S) + white layer + nitrogen-diffused layer |
| 7 | Steel 1 | 4 | Oxide layer (small amount of S) + white layer + nitrogen-diffused layer |
| 8 | Steel 2 | 4 | Oxide layer (small amount of S) + white layer + nitrogen-diffused layer |
| 9 | Steel 1 | 5 | Iron sulfide + nitrogen-diffused layer |
| 10 | Steel 2 | 5 | Iron sulfide + nitrogen-diffused layer |
| Example 1 | | | |
| 11 | Steel 1 | 6 | Mixture layer + intermediate layer + white layer + nitrogen-diffused layer |
| 12 | Steel 2 | 6 | Mixture layer + intermediate layer + white layer + nitrogen-diffused layer |
| 13 | Steel 1 | 7 | Mixture layer + intermediate layer + nitrogen-diffused layer |
| 14 | Steel 2 | 7 | Mixture layer + intermediate layer + nitrogen-diffused layer |
| 15 | Steel 1 | 8 | Mixture layer + intermediate layer + white layer + nitrogen-diffused layer |
| 16 | Steel 2 | 8 | Mixture layer + intermediate layer + white layer + nitrogen-diffused layer |

| Sample | Mixture Layer | | Maximum Galling-Free | |
|---|---|---|---|---|
| No. | S/N | S (wt %) | Pressure (MPa) | State of Surface Layer |
| Comparative Example 1 | | | | |
| 1 | — | — | 15.8 | — |
| 2 | — | — | 15.8 | — |
| 3 | — | — | 31.5 | — |
| 4 | — | — | 31.5 | — |
| 5 | 0.4 | 2.2 | 59.9 | Porous |
| 6 | — | — | 59.9 | Porous |
| 7 | 0.2 | 1.1 | 38.0 | Porous |
| 8 | — | — | 38.0 | Porous |
| 9 | 10.8 | 32.4 | 78.8 | Dense |
| 10 | — | — | 78.8 | Dense |
| Example 1 | | | | |
| 11 | 5.6 | 27.4 | 141.4 | Dense |
| 12 | — | — | 141.4 | Dense |
| 13 | 5.3 | 25.2 | 118.1 | Dense |
| 14 | — | — | 118.1 | Dense |
| 15 | 5.5 | 26.4 | 141.4 | Dense |
| 16 | — | — | 141.4 | Dense |

The samples (No. 11–16) of the present invention showed a maximum galling-free pressure in the range of 118.1–141.4 MPa, 3.7–4.5 times that of the ion-nitrided samples (Nos. 3 and 4). 2.0–2.4 times that of the samples subjected to the salt bath sulfonitriding treatment A (Nos. 5 and 6), 3.1–3.7 times that of the samples subjected to the salt bath sulfonitriding treatment B (Nos. 7 and 8), and 1.5–1.8 times that of the samples subjected to the gas sulfonitriding treatment using gases supplied from high-pressure gas bottles (Nos. 9 and 10). The above comparison has proved that the hot- or warm-usable steel members of the present invention show much improved maximum galling-free pressure as compared with those surface-treated by the conventional methods.

After reaching the maximum galling-free pressure, an end portion of each sample was cut to observe a microstructure thereof. As a result, it was found that all samples had rehardened structures, indicating that their temperatures were elevated to a level exceeding an $AC_1$ transformation temperature of the steel. This verified that there was large friction heat. The above experimental data therefore proved that the hot- or warm-usable steel member of the present invention showing much higher maximum galling-free pressure were able to remarkably suppress the friction heat.

(C) Microscopic observation and EPMA

With respect to Sample Nos. 5 and 9 (Comparative Example 1) and Sample Nos. 11 and 13 (Example 1), cross-sectional structures of their surface layers were observed by an electron microscope and an optical microscope, and the line analysis of their EPMA (electron probe microanalysis) data was carried out. The results are shown in FIGS. 1(*a*)–(*c*) for Sample No. 5, in FIGS. 2(*a*)–(*c*) for Sample No. 9, in FIGS. 3(*a*)–(*c*) for Sample No. 11, and in FIGS. 4(*a*)–(*c*) for Sample No. 13.

With respect to Sample No. 5 subjected to the salt bath sulfonitriding treatment A, outside the scope of the present invention, the maximum concentration of S in the mixture layer present in the outermost part of the surface layer was 2.2 weight % as shown in FIGS. 1(*a*)–(*c*). The concentration ratio of sulfur to nitrogen (S/N) by weight was 0.4 in the mixture layer having a thickness of 29 $\mu$m.

With respect to Sample No. 9 subjected to the gas sulfonitriding treatment by gases supplied from high-pressure gas bottles, outside the scope of the present invention, the maximum concentration of S in the mixture layer was 32.4 weight % as shown in FIGS. 2(*a*)–(*c*). The concentration ratio of sulfur to nitrogen (S/N) by weight was 10.8 in the mixture layer having a thickness of 1.2 $\mu$m.

On the other hand, in Sample No. 11 subjected to the gas sulfonitriding treatment of the present invention, the maximum concentration of S in the mixture layer was 27.4 weight % as shown in FIGS. 3(*a*)–(*c*). The concentration ratio of sulfur to nitrogen (S/N) by weight was 5.6 in the mixture layer having a thickness of 2.2 $\mu$m.

In Sample No. 13 subjected to the gas sulfonitriding treatment of the present invention, the maximum concentration of S in the mixture layer was 25.2 weight % as shown in FIGS. 4(*a*)–(*c*). The concentration ratio of sulfur to nitrogen (S/N) by weight was 5.3 in the mixture layer having a thickness of 7.0 $\mu$m.

It was thus confirmed that the oxygen-containing mixture layer comprising iron sulfide particles and iron nitride particles in Samples 11 (FIG. 3) and 13 (FIG. 4) of the present invention had a high concentration of S and an S/N ratio meeting $0.5 \leqq S/N \leqq 10$, suggesting that the mixture layer of the present invention is different in layer structure and composition from those of the conventional members.

The structures of the mixture layer, the intermediate layer and the nitride layer in Sample Nos. 11 and 13 were observed by optical and electron microscopes.

FIGS. 3(*a*)–(*b*) show that Sample No. 11 had a 2.2-μm-thick mixture layer, a 2.8-μm-thick intermediate layer and a nitride layer comprising a 7-μm-thick white layer and a 0.23-mm-thick nitrogen-diffused layer. Also, FIGS. 4(*a*)–(*b*) show that Sample No. 13 had a 7-μm-thick mixture layer, a 9.5-μm-thick intermediate layer and a nitride layer comprising a 0.17-mm-thick nitrogen-diffused layer only.

(D) Maximum hardness

With respect to Sample Nos. 5–10 and Sample Nos. 11–14, hardness was measured on a cross section of a surface layer thereof every 25 μm from the surface at a load of 100 g. The measured maximum hardness of each sample is shown in Table 4 below.

TABLE 4

| Sample No. | Steel | Treatment No. | Maximum Hardness (Hv) |
|---|---|---|---|
| Comparative Example 1 | | | |
| 5 | Steel 1 | 3 | 1,114 |
| 6 | Steel 2 | 3 | 1,121 |
| 7 | Steel 1 | 4 | 988 |
| 8 | Steel 2 | 4 | 992 |
| 9 | Steel 1 | 5 | 1,040 |
| 10 | Steel 2 | 5 | 1,046 |
| Example 1 | | | |
| 11 | Steel 1 | 6 | 1,164 |
| 12 | Steel 2 | 6 | 1,171 |
| 13 | Steel 1 | 7 | 1,125 |
| 14 | Steel 2 | 7 | 1,133 |

It is clear from Table 4 that the maximum hardness of all Sample Nos. 11–14 of the present invention was as high as 900 Hv or more, particularly 1100 Hv or more.

(E) X-ray diffraction analysis

With respect to Sample Nos. 5 and 9 and Sample Nos. 11 and 13, X-ray diffraction analysis was carried out on the outermost layer. The X-ray diffraction conditions were voltage of 40 kV with a Co target and current of 200 mA. The measured range of a diffraction angle (2θ) was 30° to 120°. The measurement results are shown in FIGS. 5(*a*)–(*d*).

The qualitative analysis results of Sample No. 5 in FIG. 5(*a*) showed that the surface layer formed by the conventional salt bath sulfonitriding method A (Treatment 3) contained iron oxide ($Fe_3O_4$), and iron nitride ($Fe_3N$ and $Fe_4N$), with no iron sulfide.

The qualitative analysis results of Sample No. 9 in FIG. 5(*b*) showed that the surface layer formed by the conventional gas sulfonitriding method using gases supplied from high-pressure gas bottles (Treatment 5) contained iron sulfide (FeS) and iron nitride ($Fe_3N$ and $Fe_4N$), with no iron oxide.

The qualitative analysis results of Sample No. 11 in FIG. 5(*c*) showed that the mixture layer formed by the gas sulfonitriding method of the present invention (Treatment 6) contained iron sulfide (FeS), iron oxide ($Fe_3O_4$) and iron nitride ($Fe_3N$ and $Fe_4N$).

The qualitative analysis results of Sample No. 13 in FIG. 5(*d*) showed that the mixture layer formed by the gas sulfonitriding method of the present invention (Treatment 7) also contained iron sulfide (FeS), iron oxide ($Fe_3O_4$) and iron nitride ($Fe_3N$ and $Fe_4N$).

Considering the above results together with the EPMA data, it was confirmed that the mixture layer of Sample No. 5 was substantially composed of $Fe_3O_4$ and $Fe_3N$ though it contained a small amount (2.2 weight %) of S. Also, considering the above results together with the optical microscopy results, it was confirmed that the nitride layer was substantially composed of $Fe_3N$ (white layer) and $Fe_4N$ (nitrogen-diffused layer).

With respect to Sample No. 9, it was confirmed that the mixture layer was substantially composed of FeS containing 32.4 weight % of S, that the intermediate layer was substantially composed of FeS and $Fe_3N$, and that the nitride layer consisted only of a nitrogen-diffused layer of $Fe_4N$.

With respect to Sample Nos. 11 and 13, it was confirmed that their mixture layers were substantially composed of FeS, $Fe_3N$ and $Fe_3O_4$, that the intermediate layers were also substantially composed of FeS, $Fe_3N$ and $Fe_3O_4$, and that the nitride layers were formed by $Fe_3N$ (white layer) and $Fe_4N$ (nitrogen-diffused layer) in Sample No. 11, and $Fe_4N$ (nitrogen-diffused layer) only in Sample No. 13.

The above results are summarized in Table 5 below.

TABLE 5

| | Surface Layer Structure | | | |
|---|---|---|---|---|
| | | Nitride Layer | | |
| Sample No. | Mixture Layer | Intermediate Layer | White Layer | Nitrogen-Diffused Layer |
| Comparative Example 1 | | | | |
| 5 | $Fe_3O_4$, $Fe_3N$, 2.2% S | — | $Fe_3N$ | $Fe_4N$ |
| 9 | FeS, 32.4% S | FeS, $Fe_3N$ | — | $Fe_4N$ |
| Example 1 | | | | |
| 11 | FeS, $Fe_3N$ and $Fe_3O_4$ | FeS, $Fe_3N$ and $Fe_3O_4$ | $Fe_3N$ | $Fe_4N$ |
| 13 | FeS, $Fe_3N$ and $Fe_3O_4$ | FeS, $Fe_3N$ and $Fe_3O_4$ | — | $Fe_4N$ |

(F) Scratch resistance

With respect to Sample Nos. 5, 7 and 9 and Sample Nos. 11 and 13, the scratch resistance of each sample surface was measured by a continuous loaded scratch tester ("REVETEST" available from Nanotec K. K.) to evaluate the adhesion of the mixture layer to the nitride layer. The measurement conditions by the continuous loaded surface tester were such that a diamond scratch needle having, a diameter of 30 μm was moved at 0.2 mm/sec. under a vertical load whose full scale was 500 g. The results are shown in Table 6.

TABLE 6

| Sample No. | Treatment No. | Scratch Resistance (gf) |
|---|---|---|
| Comparative Example 1 | | |
| 5 | 3 | 96.9 |
| 7 | 4 | 82.2 |
| 9 | 5 | 60.8 |
| Example 1 | | |
| 11 | 6 | 162.5 |
| 13 | 7 | 157.4 |

It was confirmed from the above results that Sample Nos. 11 and 13 of the present invention showed a much larger scratch resistance than that of Sample Nos. 5, 7 and 9 (Comparative Example 1). This proves that the mixture layer of the hot- or warm-usable steel member of the present invention shows better adhesion to the nitride layer than the conventional members.

Further, while the mixture layer of Sample Nos. 5 and 7 were porous, the mixture layer of Sample Nos. 11 and 13 of the present invention were dense. The porous mixture layers of the conventional members which are poorly adhered to the substrate thereof are likely to have starting points of heat cracking and propagating paths therefor due to their porosity, when subjected to a thermal stress during high-temperature forging, etc. On the other hand, the dense mixture layers of the members of the present invention well adhered to the nitride layers enjoy a prolonged life when used as a hot-working, warm-working die.

EXAMPLE 2, COMPARATIVE EXAMPLE 2

The same steel (Steel No. 1) as in Example 1 was subjected to the sulfonitriding treatment of Comparative Example 1 (Treatment No. 5 in Table 2) and to the sulfonitriding treatment of the present invention (Treatment No. 6 in Table 2). After keeping each sample at 540° C. for 20 hours, each sample was cooled to 250° C. at a cooling speed of 35–87° C./hour to investigate whether or not the formed mixture layer peeled off from the sample surface. The results are shown in Table 7 below.

TABLE 7

| Sample No. | Steel | Treatment No. | Cooling Speed (° C./hr) | Peeling of Layer After Treatment |
|---|---|---|---|---|
| Comparative Example 2 | | | | |
| 17 | Steel 1 | 5 | 870 | yes |
| 18 | Steel 1 | 5 | 220 | yes |
| 19 | Steel 1 | 5 | 145 | yes |
| 20 | Steel 1 | 5 | 58 | no |
| 21 | Steel 1 | 6 | 870 | yes |
| Example 2 | | | | |
| 22 | Steel 1 | 6 | 220 | no |
| 23 | Steel 1 | 6 | 58 | no |
| 24 | Steel 1 | 6 | 35 | no |

In the case of Treatment No. 5, the mixture layer tended off when the cooling speed of the sample reached 145° C. or higher. On the other hand, in the case of Treatment No. 6, there was no peeling of the mixture layer when the cooling speed of the sample was as low as 220° C. or less, though the peeling of the mixture layer took place at a cooling speed of 870° C./hour. Thus, it was found from these data that the cooling speed of the sufonitrided steel member should be 30–250° C./hour.

EXAMPLE 3, COMPARATIVE EXAMPLE 3

Hot-forging dies each having a diameter of 176 mm and a height of 84 mm for forming gears were produced as follows: First, Steel 2 listed in Table 1 was roughly worked to have almost the same size of the die, hardened and tempered to have a surface hardness of 53 HRC. After finish-grinding, surface treatment listed in Table 8 was conducted on the dies such that they had the same surface layer structures as those of Sample Nos. 2, 4, 8, 10, 12 and 14 listed in Table 3.

Forging was conducted on an SCM work heated by high frequency at 1200° C. by using a forging press under 1,000 tons, in such a manner that forging was repeated every 10 seconds after upsetting. The measured life of the dies is shown in Table 8 below.

TABLE 8

| Sample No. | Treatment No. | Die Life (Number) | Cause of Damage | Corresponding Sample in Table 3 |
|---|---|---|---|---|
| Comparative Example 3 | | | | |
| 25 | 1 | 3,000 | Wear | 2 |
| 26 | 2 | 5,500 | Wear | 4 |
| 27 | 4 | 7,700 | Wear | 8 |
| 28 | 5 | 6,200 | Wear | 10 |
| Example 3 | | | | |
| 29 | 6 | 16,300 | Wear | 12 |
| 30 | 7 | 14,500 | Wear | 14 |

The damage of each die was caused by wearing. The life of the dies of the present invention was about two times or more as long as that of the conventional dies, indicating that the surface layer of the present invention provided much higher wear resistance than those formed by the conventional methods.

As described above in detail, the hot- or warm-usable steel members such as hot- or warm-working dies having surface layers formed according to the present invention have improved life by thermal load-suppressing effects and heat insulating effects provided by iron sulfide particles, as well as by wear resistance retention effects provided by iron nitride particles. Because the mixture layer is dense, and because the intermediate layer serves to increase the adhesion of the mixture layer to the nitride layer, the mixture layer is less likely to peel off, and starting points of heat cracking and propagation paths therefor are less likely to be generated in the mixture layer during hot- or warm-working operations. Accordingly, the hot- or warm-usable steel members of the present invention can be used for a prolonged period of time.

What is claimed is:

1. A steel member for use under hot or warm conditions having a surface layer which comprises an oxygen-containing mixture layer comprising iron sulfide particles and iron nitride particles and substantially satisfying the formula of $0.5 \leqq S.N \leqq 10$.

2. The steel member for use under hot or warm conditions according to claim 1, further comprising a nitride layer below said mixture layer.

3. The steel member for use under hot or warm conditions according to claim 1, further comprising an intermediate layer comprising iron sulfide, iron nitride and iron oxide below said mixture layer.

4. The steel member for use under hot or warm conditions according to claim 2, further comprising an intermediate layer comprising iron sulfide, iron nitride and iron oxide between said mixture layer and said nitride layer.

5. The steel member for use under hot or warm conditions according to claim 2, wherein said nitride layer comprises a nitrogen-diffused layer.

6. The steel member for use under hot or warm conditions according to claim 4, wherein said nitride layer comprises a nitrogen-diffused layer.

7. The steel member for use under hot or warm conditions according to claim 5, wherein said nitride layer further comprises a white layer above said nitrogen-diffused layer.

8. The steel member for use under hot or warm conditions according to claim 6, wherein said nitride layer further comprises a white layer above said nitrogen-diffused layer.

9. The steel member for use under hot or warm conditions according to claim 1, wherein the concentration of S in said mixture layer is 5–35 weight %.

10. The steel member for use under hot or warm conditions according to claim 3, wherein the concentration of S in said intermediate layer is 1–10 weight %.

11. The steel member for use under hot or warm conditions according to claim 4, wherein the concentration of S in said intermediate layer is 1–10 weight %.

12. The steel member for use under hot or warm conditions according to claim 1, wherein the thickness of said mixture layer is 0.1–20 μm.

13. The steel member for use under hot or warm conditions according to claim 3, wherein the thickness of said intermediate layer is 0.1–20 μm.

14. The steel member for use under hot or warm conditions according to claim 4, wherein the thickness of said intermediate layer is 0.1–20 μm.

15. The steel member for use under hot or warm conditions according to claim 2, wherein said nitride layer has a maximum hardness of 900 Hv or more.

16. The steel member for use under hot or warm conditions according to claim 1, wherein said steel member is a hot- or warm-working die.

17. A method for producing a steel member for use under hot or warm conditions comprising the steps of:

(1) supplying a colorless ammonium sulfide solution and a yellow ammonium sulfide solution at a weight ratio of 6/1-1/1 to a gas generator to form a mixture of said solutions which generates a head gas;

(2) disposing a steel member in a reactor;

(3) introducing a mixed gas comprising said head gas and a carrier gas consisting essentially of a nitrogen gas into said reactor, said mixed gas being adjusted such that it has a hydrogen sulfide gas concentration of 100–600 ppm and an ammonia gas concentration of 0.1–1.0%;

(4) supplying a nitrogen gas and an ammonia gas from different sources to said reactor to adjust the concentration of ammonia to 10–70% in said reactor;

(5) heating the reactor to 460–600° C. to carry out a gas sulfonitriding treatment on the steel member; and (6) slowly cooling the sulfonitrided steel member at a cooling speed of 30–250° C./hr.

18. The method for producing a steel member for use under hot or warm conditions according to claim 17, wherein the concentration of ammonia in said reactor is 20–70%, and the heating temperature is 500–600° C.

19. The method for producing a steel member for use under hot or warm conditions according to claim 17, wherein the concentration of ammonia in said reactor is 10–40%, and the heating temperature is 460–550° C.

* * * * *